US006009675A

United States Patent [19]

Waalkes et al.

[11] Patent Number: 6,009,675

[45] Date of Patent: Jan. 4, 2000

[54] KNOCK-DOWN PORTABLE PARTITION SYSTEM

[75] Inventors: Michael L. Waalkes; Marcus K. Pressnell, both of Athens, Ala.; Mark T. Slager, Kentwood, Mich.; Michael R. Shields, Greensboro, N.C.; Brian J. Kane, San Francisco, Calif.; Robin Christopher, Athens, Ala.

[73] Assignee: Steelcase Development Inc., Grand Rapids, Mich.

[21] Appl. No.: 08/914,664

[22] Filed: Aug. 19, 1997

Related U.S. Application Data

[60] Provisional application No. 60/033,884, Dec. 24, 1996.

[51] Int. Cl.[7] ..... E04B 2/76

[52] U.S. Cl. ..... 52/239; 52/36.1; 52/36.6; 52/127.2; 52/127.11; 52/220.7; 52/582.2

[58] Field of Search ..... 52/36.1, 36.6, 52/239, 220.7, 582.2, 127.2, 127.11

[56] References Cited

U.S. PATENT DOCUMENTS

| | | | |
|---|---|---|---|
| 3,462,892 | 8/1969 | Meyer . | |
| 3,567,260 | 3/1971 | Norris | 52/127.11 |
| 4,154,419 | 5/1979 | Breidenbach . | |
| 4,470,232 | 9/1984 | Condevaux et al. . | |
| 4,971,281 | 11/1990 | Steinbeck . | |
| 5,063,715 | 11/1991 | Goodman . | |
| 5,209,035 | 5/1993 | Hodges et al. . | |
| 5,487,246 | 1/1996 | Hodges et al. | 52/239 X |
| 5,511,349 | 4/1996 | Kelley et al. . | |
| 5,586,593 | 12/1996 | Schwartz . | |
| 5,806,258 | 9/1998 | Miedema et al. | 52/239 X |

*Primary Examiner*—Christopher T. Kent
*Attorney, Agent, or Firm*—Price, Heneveld, Cooper, DeWitt & Litton

[57] ABSTRACT

A knock-down portable partition system has cover panels supported on a post and beam framework designed for quick and easy on-site manual assembly without tools. The framework includes at least two vertical posts with at least two beam connection ports on opposite side faces adjacent upper and lower portions of the posts. Each beam connection port has a window through the side face of the post, and first and second horizontally aligned fastener apertures in front and rear faces of the post adjacent opposite sides of the window. At least two structural beams rigidly, yet detachably interconnect the vertical posts at the upper and lower portions thereof. Each end of each of the structural beams is shaped for close reception in an associated post window, and includes a vertically oriented, transverse notch through a lower portion of the beam in which a lower edge of the post window is closely received to longitudinally lock each beam in its associated post. Each structural beam end also has a third fastener aperture that is spaced from the notch, and is horizontally aligned with the two post apertures. Fastener pins are closely, yet manually received in the first, second and third fastener apertures of each of the beam connection ports to positively retain the beams locked in the posts, such that the partition system can be completely assembled and disassembled manually without tools. Utility troughs shaped to retain wires, cabling, etc. therein have opposite ends shaped to be detachably mounted in horizontally aligned pairs of utility trough ports on the posts while the framework is in its assembled condition.

43 Claims, 12 Drawing Sheets

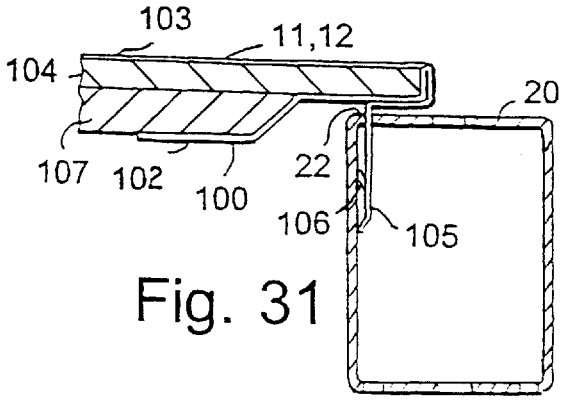
Fig. 31
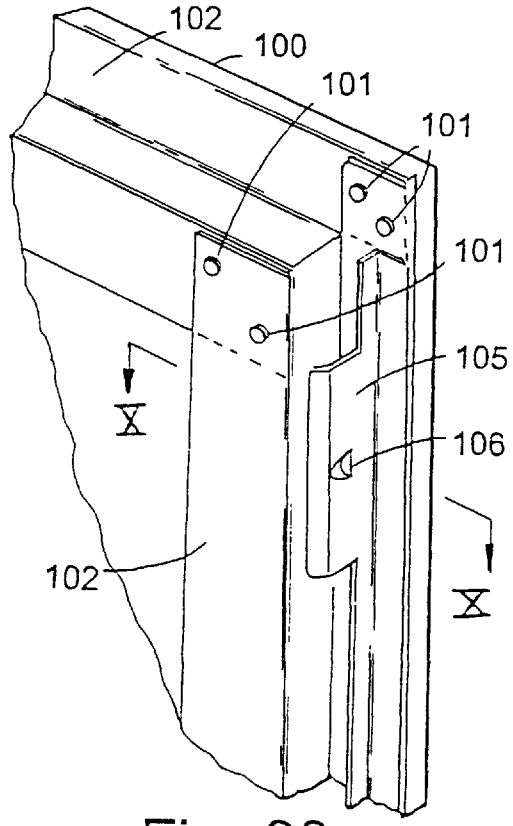
Fig. 30
Fig. 32
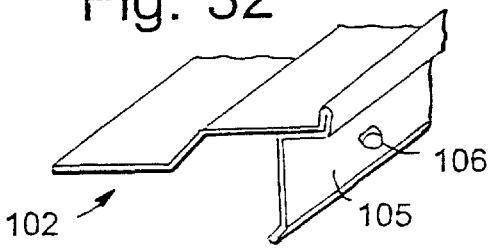
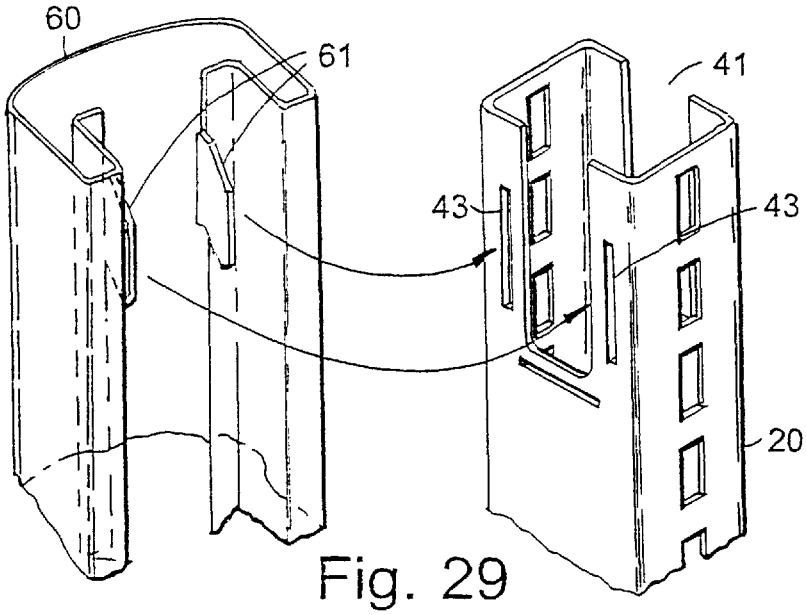
Fig. 29

KNOCK-DOWN PORTABLE PARTITION SYSTEM

CROSS-REFERENCES TO RELATED APPLICATIONS

The present application is related to commonly assigned, co-pending U.S. patent application Ser. No. 08/856,995 filed May 15, 1997, entitled KNOCK-DOWN PORTABLE PARTITION SYSTEM.

BACKGROUND OF THE INVENTION

This application claims the benefit of U.S. Provisional Application No. 60/033,884 filed Dec. 24, 1996.

The present invention relates to office partition panel systems, and in particular to a knock-down portable partition that has a unique post and beam construction configured for quick and easy on-site manual assembly without tools.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture".

Numerous partition panel systems have been developed for dividing office workspaces into smaller areas. Partition panel systems, like those disclosed in U.S. Pat. No. 4,996,811, utilize prefabricated rectangular partition panel members that have a unitary rigid perimeter frame with decorative cover panels fastened opposite sides thereof. Each perimeter frame member has a rectangular shape, and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly, or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems, like that disclosed in U.S. Pat. No. 5,150,554, utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

Other office divider systems, like that disclosed in U.S. Pat. No. 5,406,760, utilize vertical posts and horizontal beams wherein each post attaches to an adjacent post along adjacent vertical edges. Since each post is attached directly to an adjacent post, this configuration also has redundant vertical structural members and glides.

Other office panel dividers, like that disclosed in U.S. Pat. Nos. 5,287,666 and 5,219,406, have multiple posts and beams with connector members that hold a pair of beams to adjacent posts. This configuration has two horizontal beams in a side-by-side relationship at each height location, and also has two vertical posts attached directly together in either a back-to-back or side-by-side relationship. Thus, there is redundancy in both the post and the beam structures. In addition, connector pieces are required to attach the beams to the posts.

SUMMARY OF THE PRESENT INVENTION

One aspect of the present invention is a knock-down portable partition comprising a panel frame with a rigid perimeter having a substantially open central portion with quick-disconnect connectors thereon. At least one cover panel covers at least a portion of the open central portion of the panel frame. The cover panel has quick-disconnect connectors which mate with the quick-disconnect connectors on the panel frame to facilitate manual assembly and removal of the cover panel on the panel frame. The panel frame has at least two vertical posts, with at least two beam connection ports positioned adjacent upper and lower portions of the posts on the opposite side faces thereof. Each of the beam connection ports includes a window extending through an associated side face of the post and includes first and second horizontally aligned fastener apertures positioned in the front and rear faces of the posts adjacent opposite sides of the window. The panel frame also has at least two structural beams rigidly yet detachably interconnecting the vertical posts adjacent the upper and lower portions thereof. Each end of each of the beams has a shape similar to the shape of the window for close reception therein. Each end of each of the beams also has a notch extending transversely of the beam through a lower portion thereof in which a lower edge of the port window is closely received to longitudinally lock each of the beams in the posts. Each end of each beam further includes a third fastener aperture extending transversely through the beam, at a location spaced apart from the notch, and in horizontal alignment with the first and second fastener apertures. A plurality of fastener pins are closely yet manually received in the first, second and third fastener apertures of each of the beam connection ports to positively retain the beams locked in the posts, whereby the portable partition can be completely assembled and disassembled without the use of screwdrivers, wrenches, or similar tools.

Another aspect of the present invention is a knock-down portable partition comprising at least two vertical posts, each having a plurality of utility trough ports with windows for passing utility conduits therethrough. At least two structural beams are provided, each having opposite ends interconnecting the vertical posts adjacent upper and lower ends to define, when in an assembled condition, a rigid panel frame having a substantially open interior. A cover panel is removably mounted on the panel frame to readily access the open interior thereof. The partition includes at least one utility trough shaped to receive and retain utility conduits. Opposite ends of the utility trough can be detachably connected to a pair of utility trough ports when the panel frame is in an assembled condition.

Yet another aspect of the present invention is a knock-down portable partition comprising at least two vertical end posts having a plurality of beam connection ports on a vertical face of each end post. Another vertical post is located intermediate the end posts and includes beam connection ports on first and second vertical faces. At least four structural beams which rigidly interconnect each vertical end post to an intermediate post adjacent the upper and lower ends. The vertical posts and structural beams define rigid panel frames having a substantially open interior, the structural beams providing the primary structural interconnection between the intermediate post and the end posts. At least two cover panels that are removably mounted on the panel frame enclose at least a portion of the interior of the panel frames.

Yet another aspect of the present invention is a knock-down portable partition comprising two vertical posts and two structural beams. Each structural beam has at least two longitudinally extending tabs which are received in a pair of slots extending through a side face of the post. A plurality of fastener pins are closely yet manually received in first and second pairs of horizontally aligned fastener apertures positioned adjacent opposite sides of each said slot in front and rear faces of the posts, and also through a third pair of fastener apertures which extend transversely through the beam. The vertical posts and structural beams form a panel frame having a rigid perimeter with a substantially open central portion which is covered by at least one cover panel which is retained with quick-disconnect connectors.

The principal objects of the present invention are to provide a knock-down, portable partition system. Accordingly, the present partition provides a versatile, easily assembled and disassembled partition having reduced complexity, and fewer components. The individual components are assembled at the installation site, thereby reducing shipping costs, and allowing for longer, more economical panel sizes. The partition panel is easily and quickly assembled without the use of hand tools. Utility troughs may be installed at various heights between the posts to provide for electrical and communications conduits. The utility troughs may be installed or removed after the structural beams are installed between adjacent posts. Removable cover panels are installed to close off the open interior of the panel. Two adjacent cover panels are attached to a single post at each in-line panel joint.

These and other features, objects and advantages of the present invention will become apparent upon reading the following description thereof together with reference to the accompanying drawings.

BRIEF DESCRIPTION OF DRAWINGS

FIG. 29 is a fragmentary, perspective view of the end-of-run post and vertical trim strip.

FIG. 30 is a fragmentary, perspective view of a cover panel showing the cover panel retainer tabs.

FIG. 31 is a fragmentary, cross-sectional view of the cover panel and vertical post, taken along the line X, FIG. 30.

FIG. 32 is a fragmentary, horizontal cross-sectional view of the cover panel frame channel, taken along the line X—X, FIG. 30, shown mounted on a vertical post.

DETAILED DESCRIPTION OF THE PREFERRED EMBODIMENTS

Figure 1:
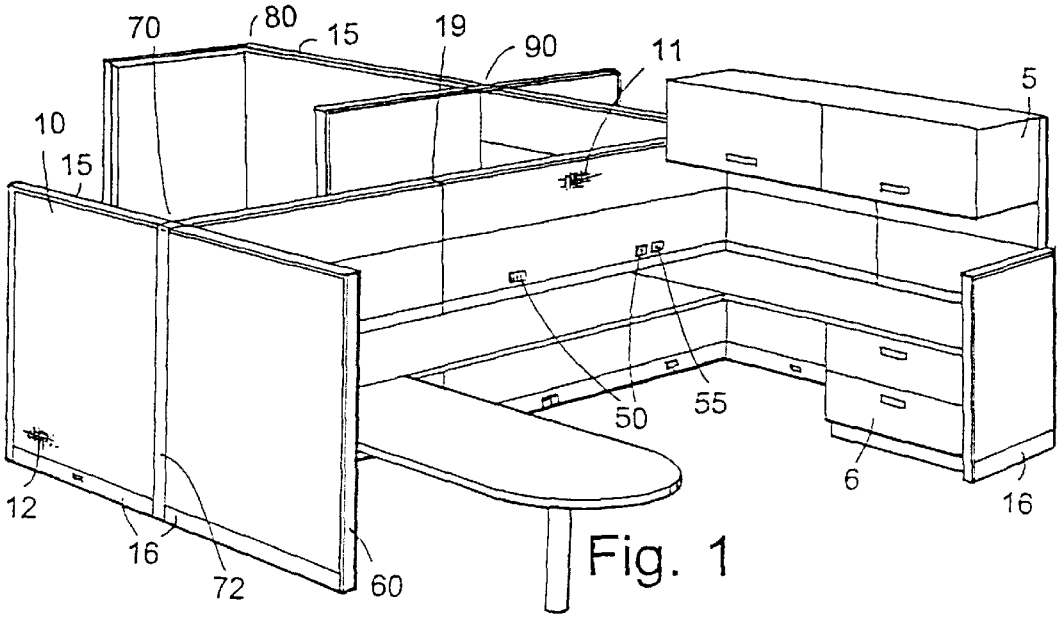
FIG. 1 is a perspective view of a knock-down partition system embodying the present invention, comprising a post and beam construction which is covered by decorative cover panels.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
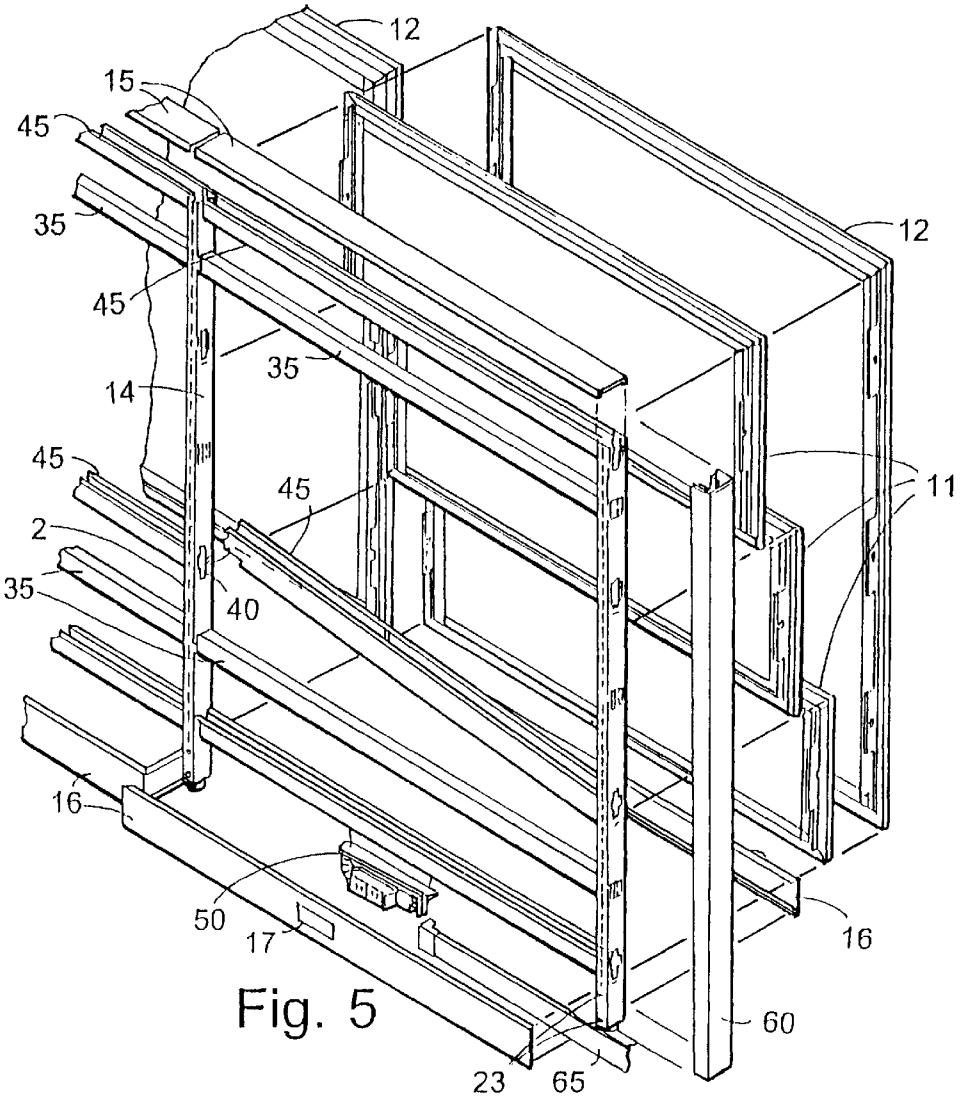
FIG. 5 is a fragmentary, exploded, perspective view of the partition showing the cover panels and trim pieces, and installation of a utility trough.
Figure 16:
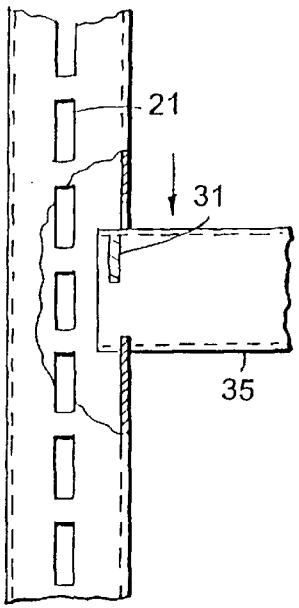
FIG. 16 is a fragmentary, front elevational view of the vertical post with the structural beam in an installed condition.

The reference numeral 1 (FIG. 1) generally designates a knock-down portable partition system embodying the present invention. The illustrated knock-down portable partition system 1 has cover panels 11, 12 supported on a post and beam framework 2 (FIG. 5) designed for quick and easy on-site manual assembly without tools. Framework 2 includes at least two vertical posts 20 with at least two beam connection ports 30 on opposite side faces 14 adjacent upper and lower portions of the posts. Each beam connection port 30 (FIG. 14) has a window 34 through the side face 14 of post 20, and first and second horizontally aligned fastener apertures 32 and 33 in front and rear faces 27 and 28 of the post 20 adjacent opposite sides of the window 34. At least two structural beams 35 rigidly, yet detachably interconnect vertical posts 20 at the upper and lower portions thereof (FIG. 5). Each end of each of the structural beams 35 (FIG. 14) is shaped for close reception in an associated post window 34, and includes a vertically oriented, transverse notch 39 through a lower portion of the beam 35 in which a lower edge of the post window 34 is closely received to longitudinally lock each beam 35 in its associated post 20 (FIG. 16). Each structural beam end also has a third fastener aperture 36 that is spaced from the notch 39, and is horizontally aligned with the two post apertures 32 and 33. Fastener pins 31 (FIG. 13) are closely, yet manually received in the first, second and third fastener apertures 32, 33, and 36 of each of the beam connection ports 30 to positively retain the beams 35 locked in the posts 20, such that the partition system 1 can be completely assembled and disassembled manually without tools. Utility troughs 45 (FIGS. 18–21) shaped to retain wires, cabling, etc. therein have first and second ends 57 and 58 that are shaped to be detachably mounted in horizontally aligned pairs of utility trough ports 40 on the posts 20 while the framework 2 is in its assembled condition (FIG. 5).

Figure 4:
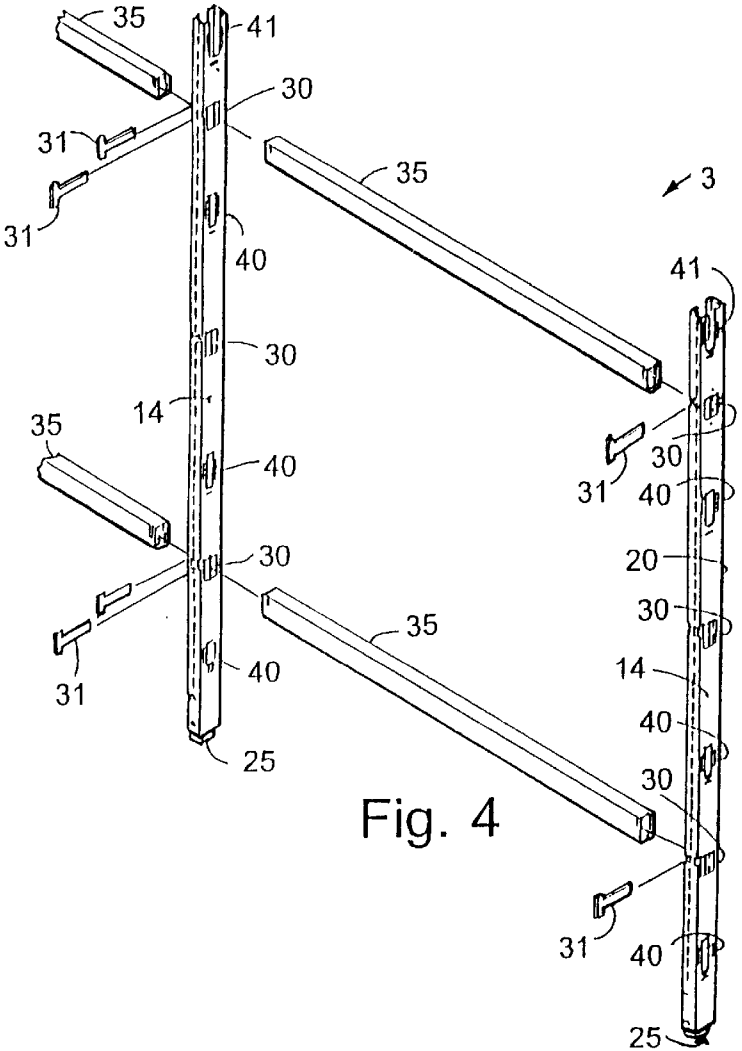
FIG. 4 is a fragmentary, exploded, perspective view of the vertical posts, beams, and pins.
Figure 3:
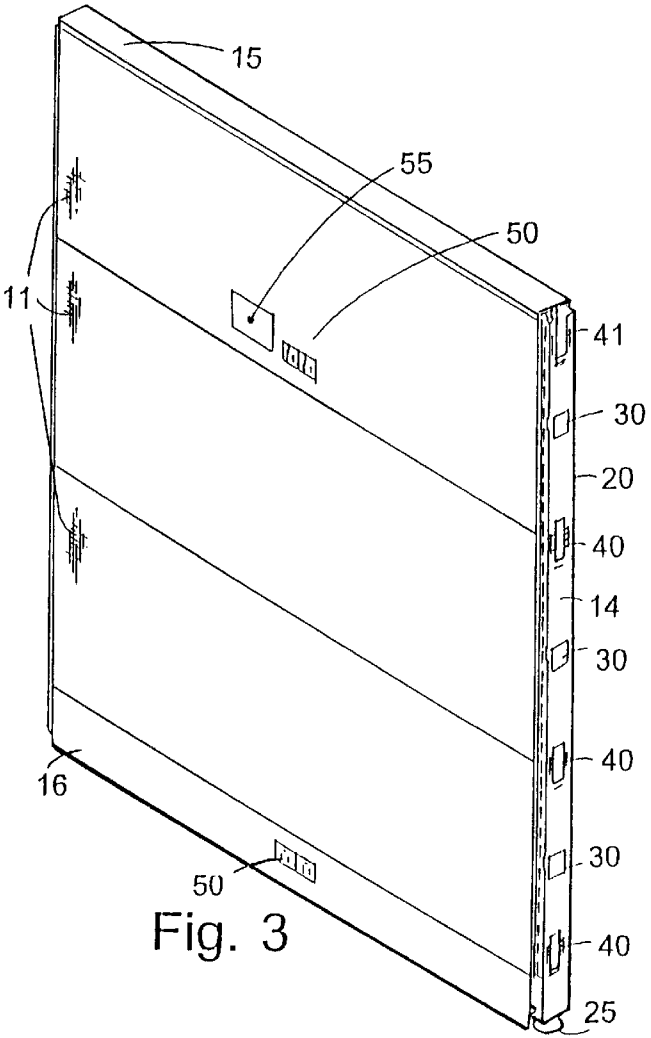
FIG. 3 is a perspective view of an individual panel section.
Figure 7:
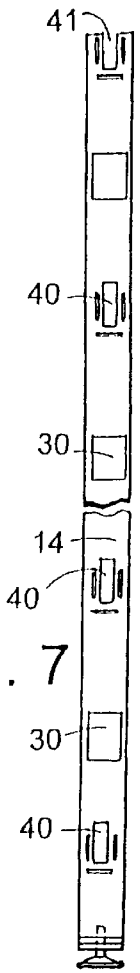
FIG. 7 is a fragmentary, side elevational view of the vertical post.

Four different post configurations are utilized, including an in-line or end-of-run post 20, a T-post 71, L-post 81, and X-post 91. Each of the post configurations has a plurality of beam connection ports 30 and utility trough connection ports 40 located on side faces 14 in a similar arrangement as the vertical post 20 described below. With reference to FIGS. 3–5, each vertical post 20 may be used for an in-line joint 19, or at an end-of-run location, where the vertical post 20 is covered by a vertical trim strip 60. Structural beams 35 are received into structural beam connection ports 30 located on the vertical faces of a pair of vertical posts 20. Pins 31 are received in first, second and third horizontally aligned fastener apertures 32, 33, and 36, rigidly locking the structural beams to the vertical posts 20. Base covers 16 may be made from roll-formed steel sheet, and include retainer tabs 18 which removably retain the base cover 16 in base cover mounting slots 23, located at the lower end of vertical posts 20. Base covers 16 include apertures 17 for receiving electrical receptacles 50. Since each post 20 receives at least two structural beams 35 into the connection ports 30 on both opposite side faces 14 at an in-line joint 19, each panel frame 3 shares a common vertical post 20 with an adjacent panel frame 3. Each panel frame 3 may include either segmented cover panels 11, or a single cover panel 12 to form a panel section 10.

Figure 8:
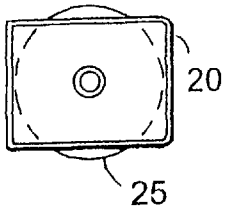
FIG. 8 is a top plan view of the vertical post.
Figure 9:
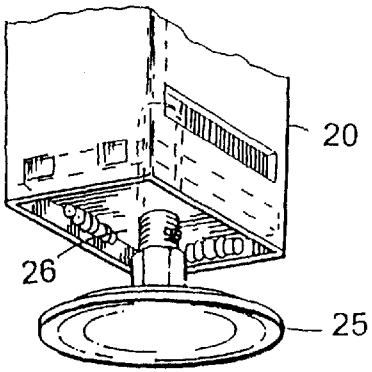
FIG. 9 is a fragmentary, perspective view of a glide.

With reference to FIGS. 6–9, each vertical post 20 has a plurality of structural beam connection ports 30, and a plurality of utility trough connection ports 40 on each opposite side face 14. The upper utility trough 41 is similar to utility trough connection port 40, but includes an open upper edge for laying-in cabling along the upper edge of panel sections 10. First quick-disconnect connectors are formed by a plurality of cover panel mounting slots 22 which are evenly spaced along the front and rear faces 27, 28 of the vertical post 20 near the opposite side faces 14. Base cover mounting slots 23 are located on front and rear faces 27 and 28 near the lower end of vertical posts 20. As shown in FIG. 9, each foot or glide 25 is threadingly received into a glide plate 26. The rectangular glide plate 26 is welded into the lower end of vertical post 20. Each in-line vertical post 20 has a rectangular tubular cross-section as illustrated in FIG. 8.

Figure 10:
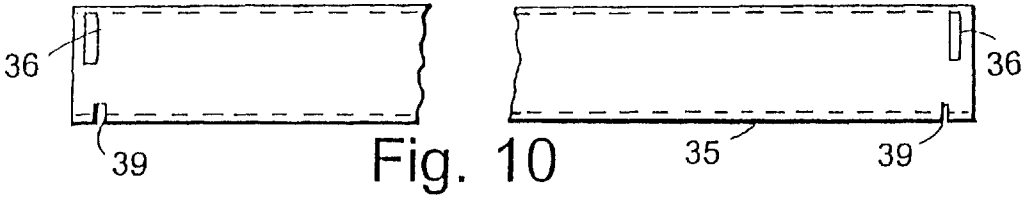
FIG. 10 is a fragmentary, front elevational view of the structural beam.
Figure 11:
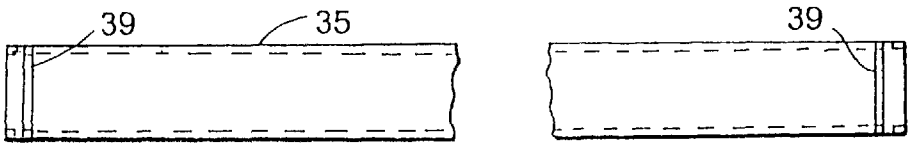
FIG. 11 is a fragmentary, bottom plan view of the structural beam.
Figure 12:
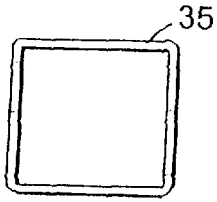
FIG. 12 is a side elevational view of the structural beam.
Figure 14:
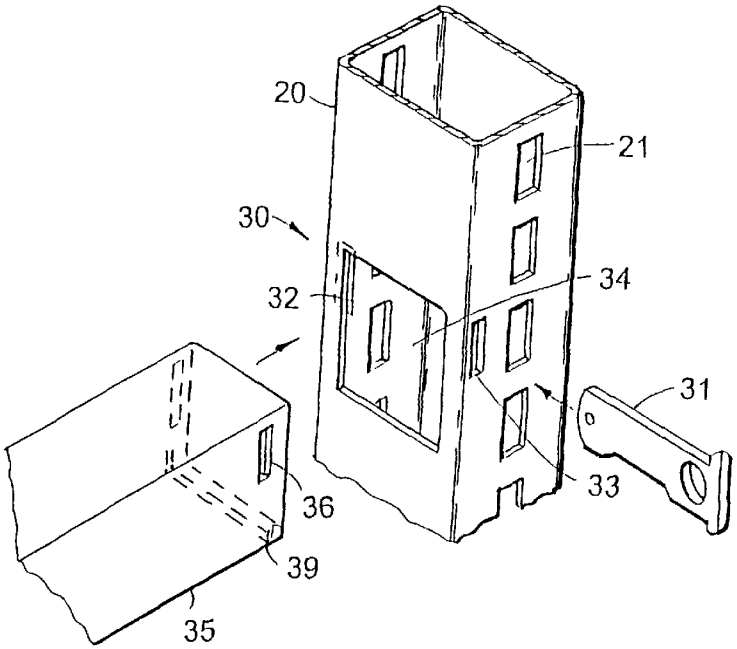
FIG. 14 is a fragmentary, perspective view of the vertical post, structural beam, and pin, showing a structural beam connection port in the vertical post.

With reference to FIGS. 10–12, each structural beam 35 has a square or rectangular tubular cross section and includes a vertically oriented notch 39 extending transversely. A third fastener aperture 36 is located adjacent each end of the structural beam 35. As shown in FIG. 14, each structural beam connection port 30 includes a window 34 defined by an edge having a shape similar to that of structural beams 35 for receiving an end of the structural beams 35. The vertically oriented transverse notch 39 has a width that is approximately equal to the thickness of the wall of the vertical post 20, resulting in a frictional engagement when the notch 39 is engaged on the lower edge of a window 34. Each structural beam connection port 30 includes first and second horizontally aligned fastener apertures 32 and 33 which receive pin 31 when a structural beam 35 is received in the window 34.

Figure 13:
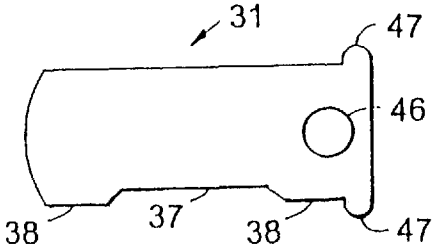
FIG. 13 is a side elevational view of the pin.

Each pin 31 is made from flat metal stock, and has a profile as illustrated in FIG. 13. Contact surfaces 38 engage the upper and lower edges of first, second and third fastener apertures 32, 33 and 36 with a minimal clearance, thereby providing a rigid, secure connection between the structural beam 35 and vertical post 20 and also allowing insertion and removal of the pin 31 without use of tools. Narrow intermediate section 37 provides clearance to facilitate installation of pin 31. Stops 47 contact the front or rear face 27 or 28 of post 20 when the pin 31 is fully engaged. Circular aperture 46 receives a tool such as a screwdriver to aid in the removal of pin 31 if required.

Figure 17:
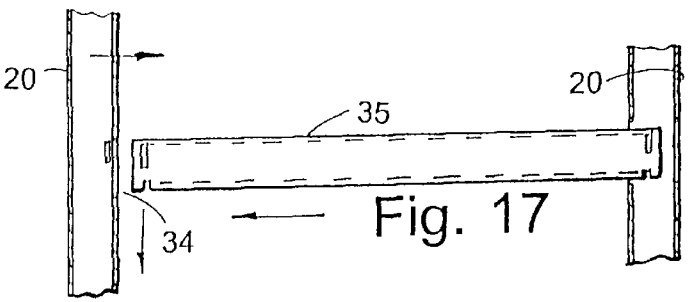
FIG. 17 is a fragmentary, front elevational view of a structural beam during installation to a pair of vertical posts.
Figure 15:
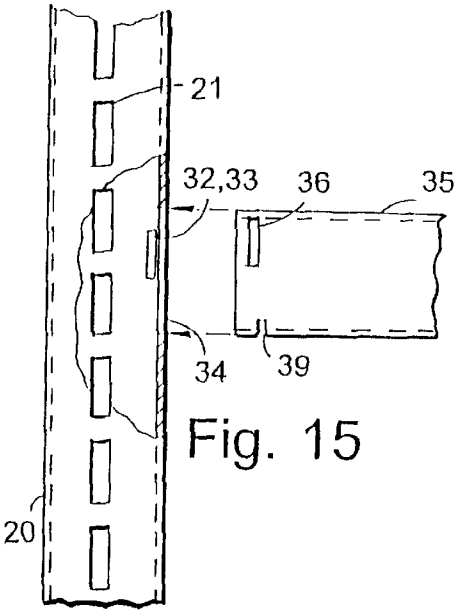
FIG. 15 is a fragmentary, front elevational view of the vertical post and structural beam prior to assembly.

As illustrated in FIGS. 15–17, during assembly of the framework 2, each end of a structural beam 35 is inserted into the window 34 of a structural beam connection port 30. The structural beam 35 is then pressed downward to engage the lower edge of window 34 into the vertically oriented transverse notch 39. The first, second and third fastener apertures 32, 33 and 36 are then horizontally aligned, and a pin 31 is inserted through the fastener apertures, thereby securely locking the structural beam to the vertical post. Each vertical post 20 that is used at an in-line joint 19 receives structural beam 35 into each of the opposite faces, such that each adjacent panel frame 3 shares a common vertical post 20.

Figure 18:
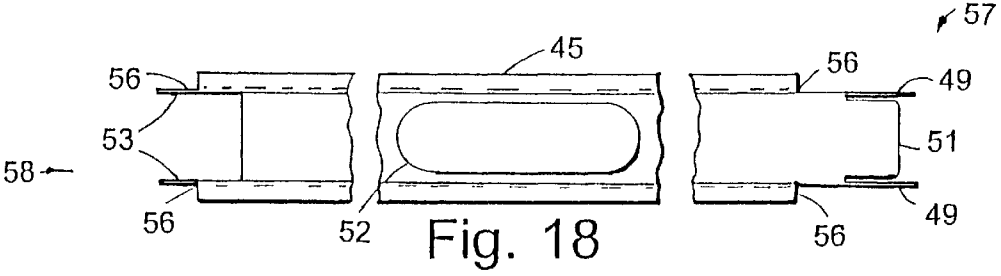
FIG. 18 is a fragmentary, top plan view of the utility trough.
Figure 19:
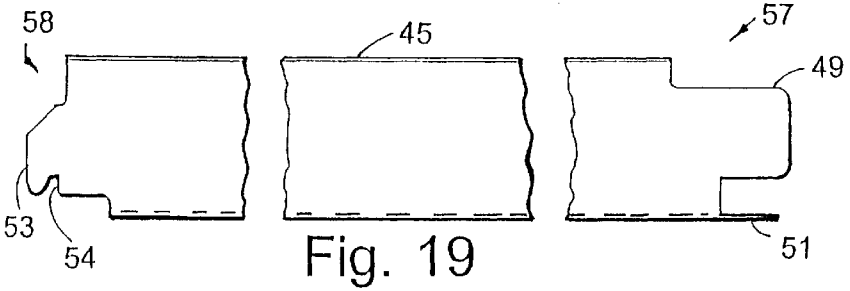
FIG. 19 is a fragmentary, front elevational view of the utility trough.
Figure 20:
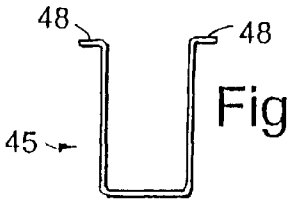
FIG. 20 is a side elevational view of the utility trough.
Figure 24:
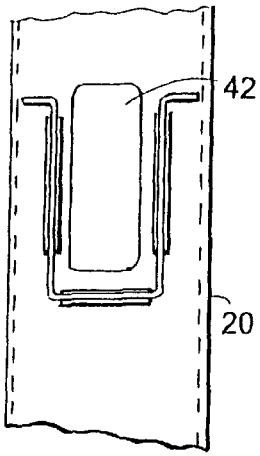
FIG. 24 is a fragmentary, side elevational view showing the utility trough in an installed condition.
Figure 23:
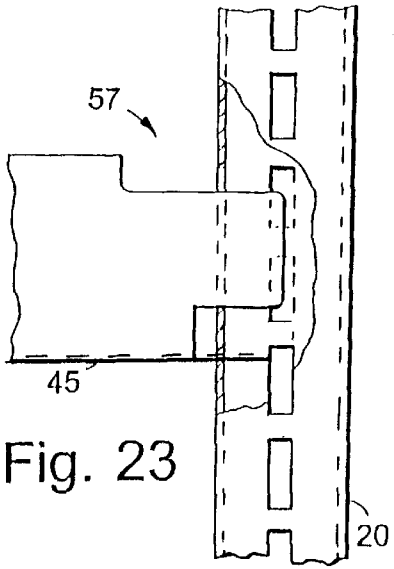
FIG. 23 is a fragmentary, front elevational view of the vertical post with a first end of the utility trough in an installed condition.
Figure 22:
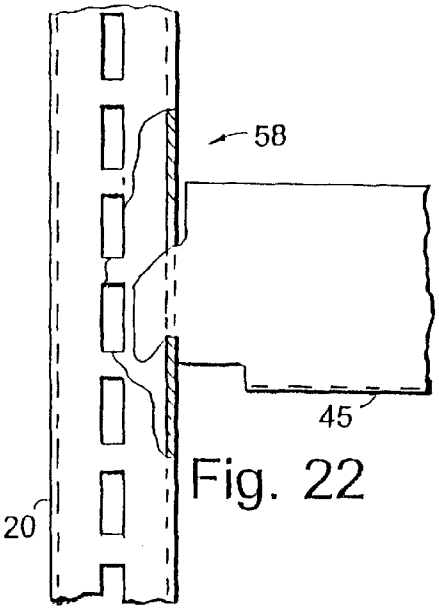
FIG. 22 is a fragmentary, front elevational view of a vertical post and a second end of the utility trough in an installed condition.
Figure 25:
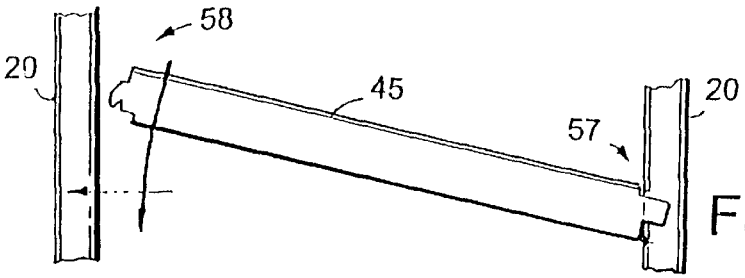
FIG. 25 is a fragmentary, front elevational view showing the installation of a utility trough between a pair of the vertical posts.

As shown in FIGS. 18–20, each utility trough 45 may be roll-formed from a pre-coated roll of steel and has an inverted U-shaped cross section that extends substantially uninterrupted between a pair of posts 20. Each utility trough 45 includes horizontal flanges 48 along the upper edge. The horizontal flanges 48 are configured to provide support for a cover panel 11 or 12, and have a cut-out portion 56 near each end of the utility trough 45 to provide clearance for the frame 100 of cover panel 11 or 12. Vertical tabs 49 and horizontal tab 51 are located at a first end 57 of the utility trough 45. Hook-shaped tabs 53 are located at a second end 58 of utility trough 45, and define a tapered, vertically-oriented slot 54.

Figure 21:
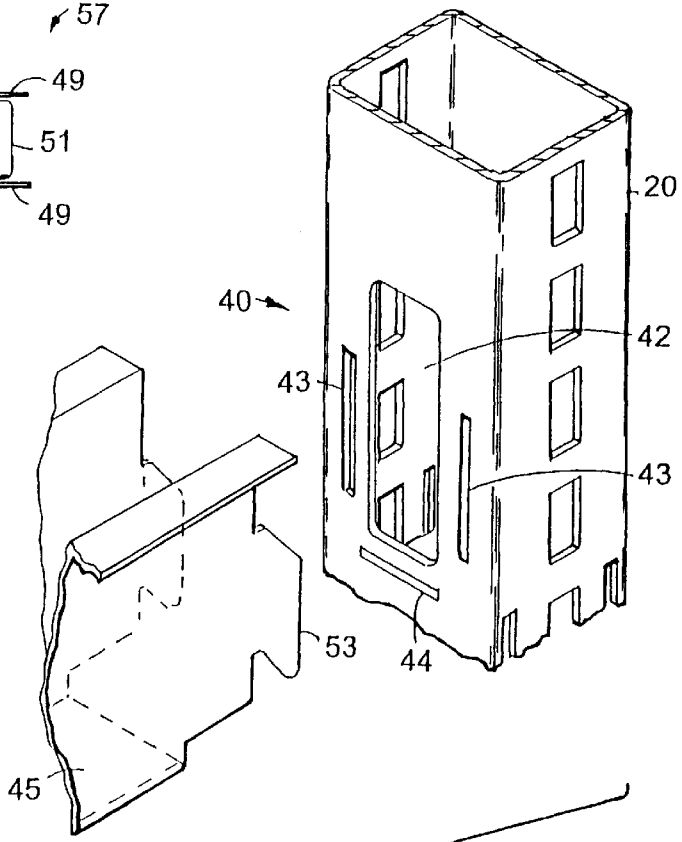
FIG. 21 is a fragmentary, perspective view of the vertical post and utility trough in an unassembled condition, showing the utility trough connection port.

With reference to FIG. 21, each utility trough connection port 40 includes a window 42 for passing electrical or communications conduit through the vertical post 20. A pair of vertically-oriented slots 43 receive the vertical tabs 49 or hook-shaped tabs 53 of a utility trough 45. Each utility trough connection port 40 also includes a horizontally oriented slot 44 that receives horizontal tab 51 when the first end 57 of a utility trough 45 is inserted.

Utility troughs 45 are installed after the framework 2 is assembled from posts 20 and beams 35. As illustrated in FIGS. 22–25, during installation the first end 57 of utility trough 45 is slid into the vertical slots 43 and horizontal slot 44 of a utility trough connection port 40. The second end 58 of utility trough 45 is then rotated downward to partially engage hook-shaped tabs 53 into slots 43 and shifted in a horizontal direction to engage the tapered, vertically oriented slots 54 into the bottom edge of vertically oriented slots 43. In a similar manner, utility trough 45 may be removed from a pair of vertical posts 20 after the framework 2 has been assembled. When in an installed condition, utility troughs 45 are aligned with the windows 42 in vertical post 20 to allow electrical or communications cabling to pass therethrough.

Figure 26:
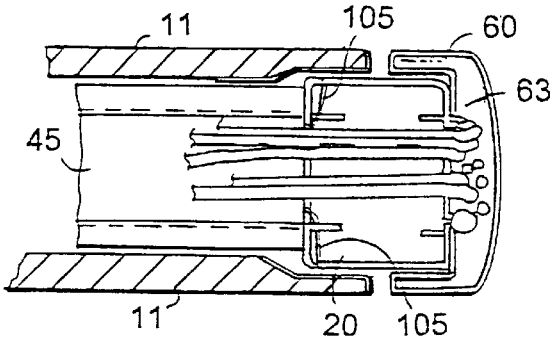
FIG. 26 is a fragmentary, horizontal cross-sectional view of an end-of-run post and vertical trim strip.

As illustrated in FIGS. 26 and 29, at an end-of-run location, a vertical post 20 receives a vertical trim strip 60. Trim strip 60 includes hooks 61 which are received in vertical slots 43 of a utility trough connection port 40 or 41. Vertical trim strip 60 extends away from vertical post 20 to provide an external vertical raceway 63 for laying-in of wires along an outer face of the vertical post 20.

Figure 28:
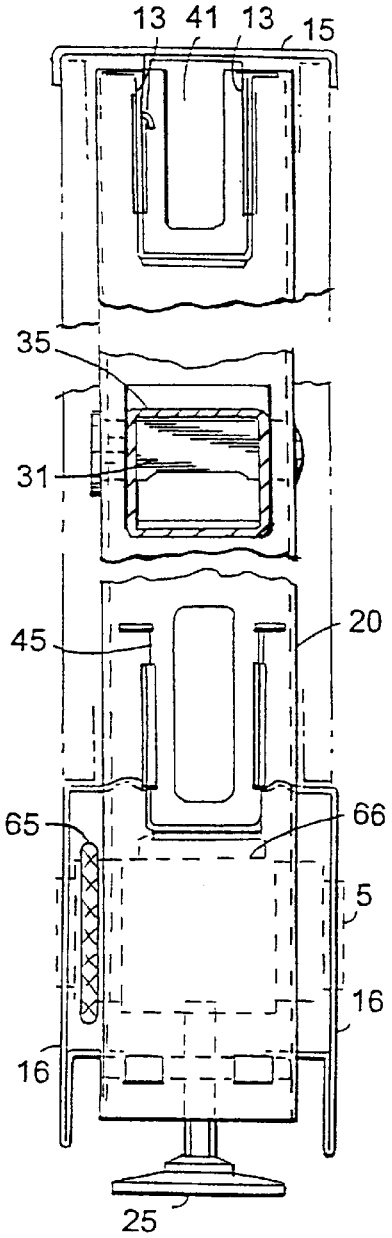
FIG. 28 is a fragmentary, vertical cross-sectional view of a wall panel showing flat electrical cables running between the front face of a vertical post and the base cover.

As illustrated in FIG. 28, bracket 66 retains electrical receptacle 50 to the under side of a utility trough 45 located adjacent the lower edge of a panel section 10. Flat electrical cable 65 runs along the base of panel sections 10, and passes over a front or rear face 27 or 28 of a vertical post 20, and is covered by base covers 16.

Figure 27:
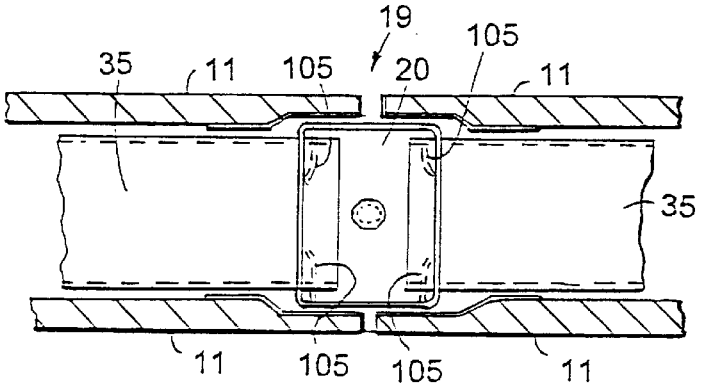
FIG. 27 is a fragmentary, horizontal cross-sectional view of an in-line vertical post with structural beams and cover panels from adjacent panel sections connected to the vertical post.

As illustrated in FIGS. 30–32, a frame 100 of cover panel 11 or 12 includes cover panel retainer tabs 105. Each cover panel retainer tab 105 has a lance tab 106 which engages the inner surface of vertical post 20 when the cover panel retainer tab 105 is inserted into the cover panel mounting slots 22. At each corner of frame 100, the channels 102 are joined with integrated rivets or "toggle locks" 101. The retainer tabs 105 have a cross-sectional shape illustrated in FIG. 31. As illustrated in FIG. 27, each vertical post 20 has two rows of cover panel mounting slots 22 on side faces 14 that receive cover panel retainer tabs 105 of cover panels 11. Each vertical post 20 retains two adjacent edges of two cover panels 11 on each side face 14.

Figures 33, 34, 35:
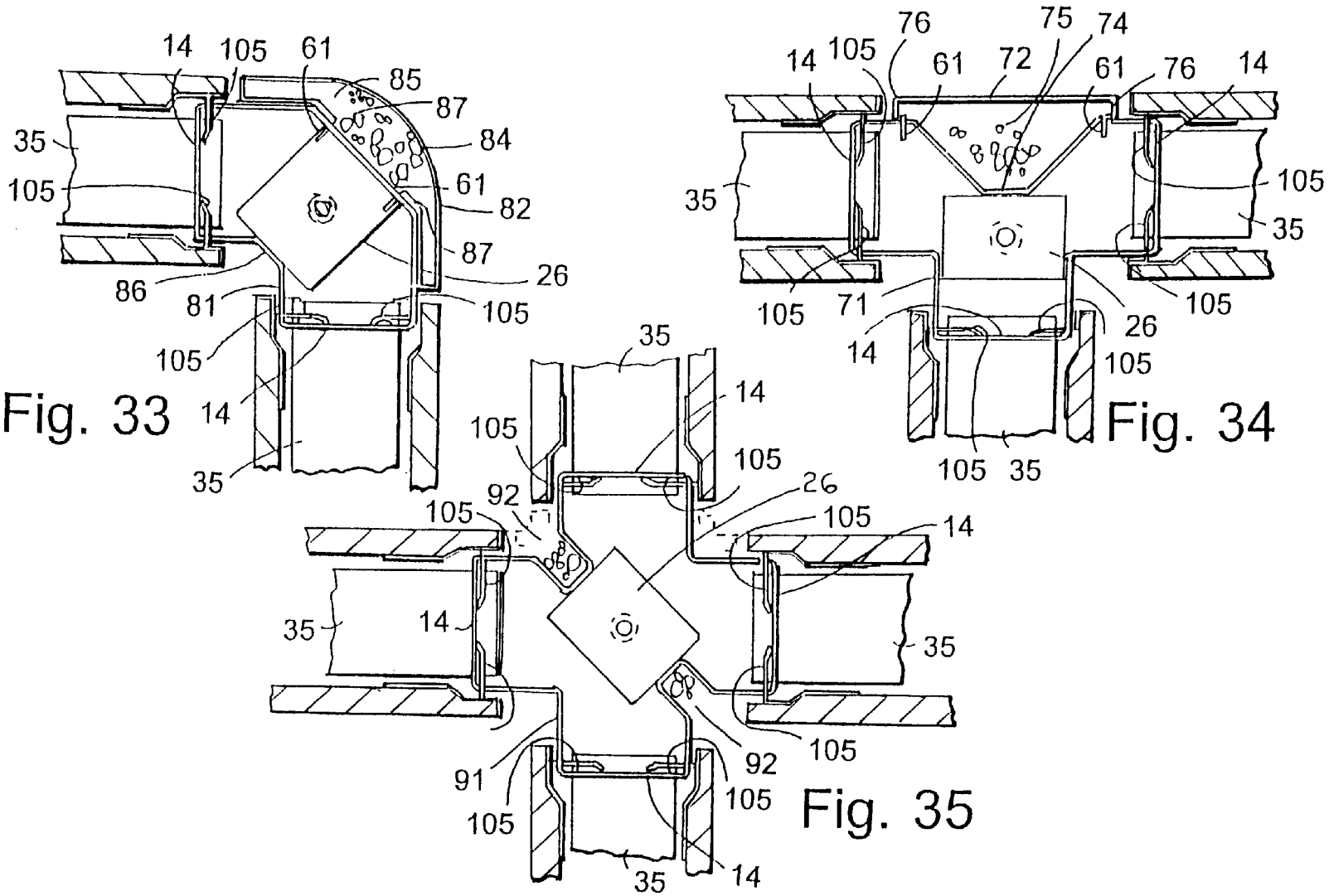
FIG. 33 is a fragmentary, cross-sectional, top plan view of an L-post and trim strip, showing the vertical raceway.
FIG. 34 is a fragmentary, horizontal cross-sectional view of an L-post and trim strip, showing a vertical raceway.
FIG. 35 is a fragmentary, horizontal cross-sectional view of an X-post, showing vertical cable channels.

As illustrated in FIGS. 33–35, T-post 71, L-post 81 and X-post 91 are used at T-joints 70, L-joints 80 and X-joints 90, respectively. All of the post configurations have a plurality of structural beam connection ports 30 and a plurality of utility trough connection ports 40 located on side faces 14 in substantially the same configuration as vertical post 20. In addition, each of the post configurations has a plurality of vertical slots 22 for receiving cover panel retainer tabs 105 in substantially the same manner as vertical post 20. All of the post configurations have a cross-sectional shape that receives a single-size glide plate 26 which is welded into a lower end of each post. With reference to FIG. 33, each L-post 81 has an outer chamfered portion 84, and receives an L-post trim strip 82 over the outer chamfered portion 84 to form a vertical raceway 85. The inner and outer chamfered portions 86 and 84, respectively are configured to receive a glide plate 26. The L-post trim strip 82 has hooks 61 which are received in slots 87 on the chamfered portion 84 of L-post 81 to retain the trim strip 82. As illustrated in FIG. 34, each T-post 71 includes a recessed portion 74 which is covered with a T-post trim strip 72, thereby creating a vertical raceway 75 for the laying-in of cabling. The recessed portion 74 is configured to receive a glide plate 26, which is welded into the lower portion of the T-post 71. The T-post trim strip 72 includes hooks 61 which are received in slots 76 in T-post 71. As shown in FIG. 35, X-post 91 has opposing vertical channels 92 which are configured to receive a glide plate 26 at the lower end of X-post 91. Cables may be laid into vertical channels 92. Each post configuration includes base cover mounting slots 23 adjacent to receive retainer tabs 18 of base covers 16.

Figure 36:
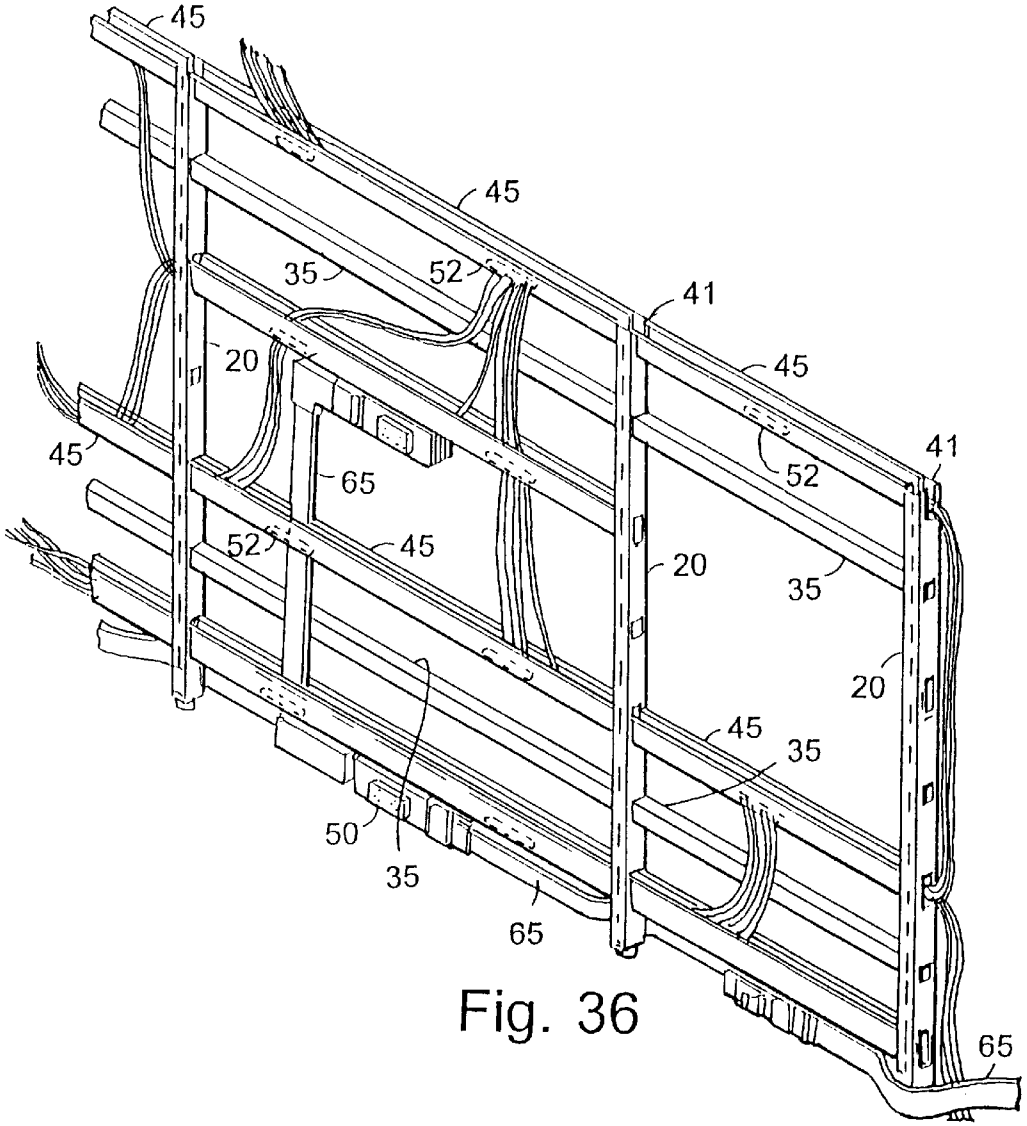
FIG. 36 is a fragmentary, perspective view of the post and beam framework with utility troughs and wiring installed.

As illustrated in FIG. 36, a utility trough 45 may be installed in various utility trough connection ports 40 or 41 to provide electrical and communication cabling at the desired heights. Utility troughs 45 can be quickly and easily removed or installed to reconfigure the cabling as required. Apertures 52 in utility troughs 45 allow the electrical and/or communications cabling to be run vertically in the open interior of a panel section 10. The upper utility connection ports 41 facilitate laying-in of communication and/or electrical cabling along the top edge of the partition system 1. The vertical trim strips 60, 72 and 82, allow for vertical cabling external of a vertical post 20, T-post 71, or L-post 81, respectively.

Figure 37:
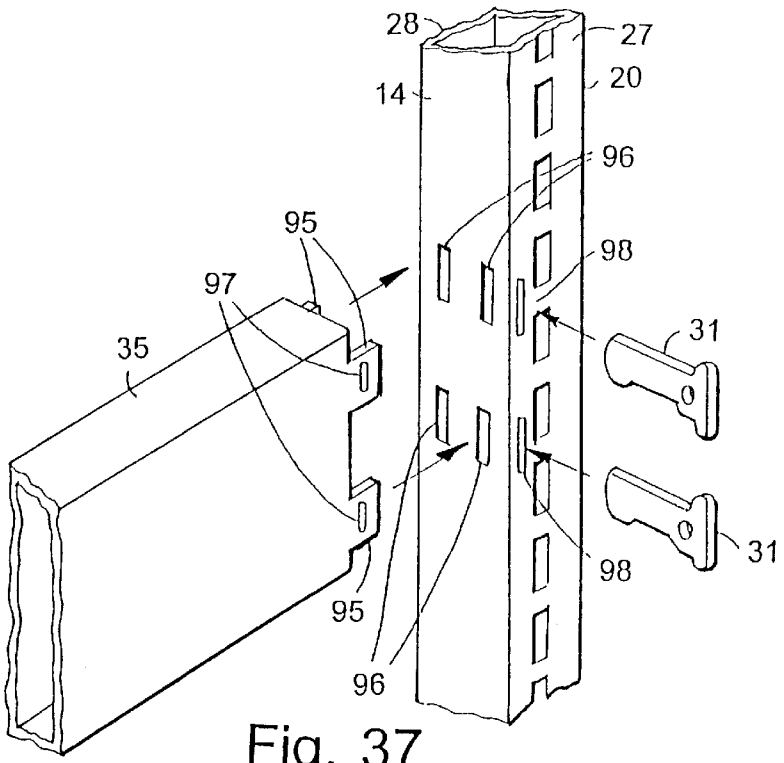
FIG. 37 is a fragmentary, perspective view of an alternative structural beam, vertical post, and associated structural beam connection port.

An alternative embodiment of the structural beam and structural beam connection port is illustrated in FIG. 37. In this embodiment, each structural beam connection port 30 includes two pairs of structural connector slots 96 on a side face 14 of a vertical post 20, and first and second pairs of fastener apertures 98 positioned adjacent opposite sides of each of the slots 96 in front and rear faces 27 and 28 of the post 20. Each end of each structural beam 35 has two pairs of structural connector tabs 95. Each structural connector tab 95 has a third pair of fastener apertures 97, which are aligned with a corresponding pair of second fastener apertures 98, and receive pins 31 to rigidly secure the structural beam 35 to the vertical post 20.

Cover panels 11 and 12 include a glass fiber mat 104 which is covered by a fabric material 103 for decorative purposes (FIG. 31). An acoustical layer 107 of loosely woven synthetic material provides additional insulation. The cover panels 11 and 12 are decorative, non-structural members.

Figure 2:
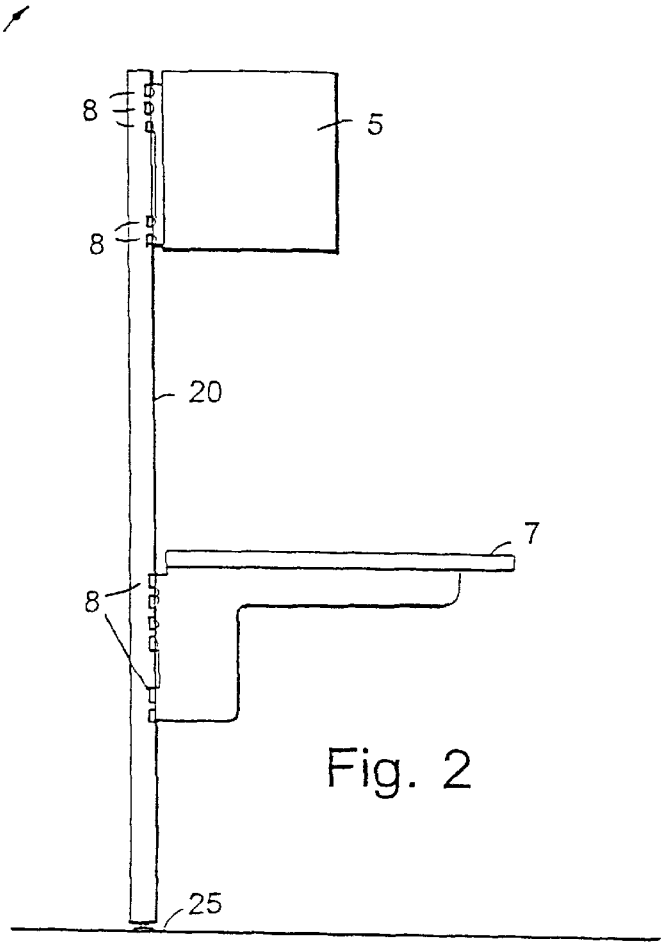
FIG. 2 is a partially schematic side elevational view of the partition system with hang-on bins and worksurfaces installed.
Figure 6:
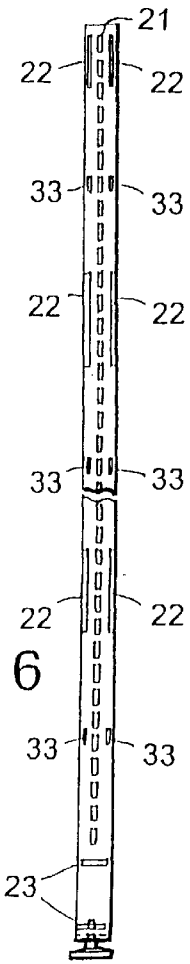
FIG. 6 is a fragmentary, front elevational view of the vertical post.

With reference to FIGS. 1, 2 & 6, each of the vertical post configurations has a row of slots 21 which receive hooks 8 for supporting conventional hang-on items such as overhead bin 5, lower file bin 6, and worksurface 7. This arrangement provides flexibility to install and remove the various hang-on items, and also allows vertical adjustment of the worksurfaces 7.

With reference to FIG. 28, each top trim strip 15 has a pair of retainer tabs 13 which engage the inner surface of a utility trough 45 to removably retain the trim strip 15 along the top edge of the partition panel system 1. Alternately, tabs 13 may be configured to be inserted between a cover panel 11 and the flange 48 of a utility trough 45 to removably retain the trim strip 15 (not shown).

Figure 38:
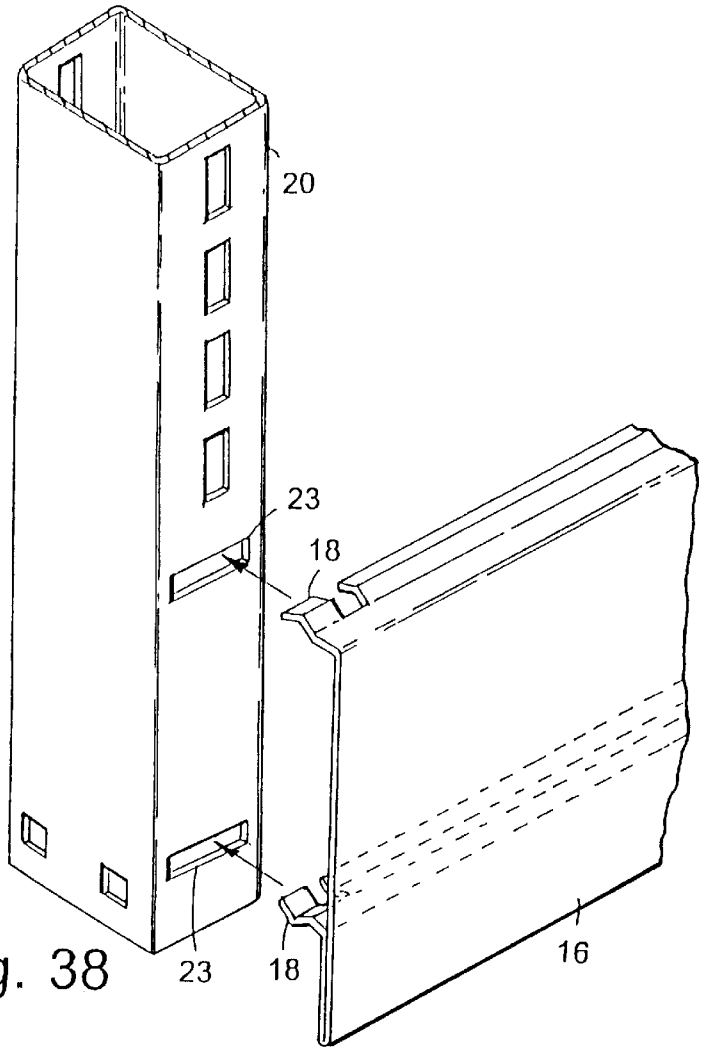
FIG. 38 is a fragmentary, perspective view of a base cover showing the retainer tabs and base cover mounting slots.

As illustrated in FIG. 38, each base cover 16 includes a pair of tabs 18 located at each end thereof. Each tab 18 is received into a base cover mounting slot 23, located adjacent the lower end of a vertical post 20. Each base cover mounting slot 23 receives two retainer tabs 18, one from each adjacent base cover 16.

During assembly of the knock-down portable partition system 1, a pair of structural beams 35 are installed between a pair of vertical posts 20 to form panel frames 3. After the post and beam framework 2 is assembled, the framework 2 is leveled by adjusting glides 25. Alternatively, an L-post 81, or a T-post 71, or an X-post 91 may be used as the first vertical post in the assembly process for stability. After the post and beam framework 2 is assembled, the utility troughs 45 are installed between each adjacent pair of posts at the desired height (FIG. 5). The electrical and communications cabling may then be installed at the desired heights (FIG. 5, 36). A flat electrical cable 65 and electrical receptacles 50 may be installed to a utility trough 45 located at the base of the framework 2. The electrical receptacles 50 may be mounted to utility troughs 45 utilizing brackets 66 along the base of framework 2. The flat electrical cables 65 are run across the front and/or rear faces of the vertical posts 20 (FIG. 36), and behind base covers 16. The cabling can be routed vertically either between panels through apertures 52 in utility troughs 45, or at a vertical post 20 at an end-of-run location. Alternatively, the electrical and/or communications cabling may be run vertically at an L-post, T-post, or X-post as illustrated in FIGS. 33–35. In addition, cabling may be run vertically through the center of any of the vertical posts if required. Cover panels 11 or 12 are then installed by inserting the tabs 105 into slots 22 in the vertical posts 20. Base covers 16 are then snapped into slots 23 in the vertical posts 20. If desired, knock-outs on the base cover are removed to create apertures 17 which provide clearance for the electrical receptacle 50. The top trim strips 15 and the vertical post trim pieces 60, 72 and 82 may then be installed.

It will become apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A knock-down frame construction for portable partitions, comprising:

at least two vertical posts each having a unitary construction with an upper end, a lower end and opposite side faces with at least two beam connection ports thereon positioned adjacent the upper and lower ends of the associated one of said posts said side faces facing inwardly toward one another, each post defining front and rear faces with a vertical row of openings thereon for supporting hang-on accessory units;

upper and lower beams extending generally horizontally between said vertical posts adjacent the upper and lower ends thereof, and interconnecting the same adjacent said connection ports;

first quick-disconnect connectors positioned on said posts adjacent said connection ports, each first quick-disconnect connector including an opening through said side faces; and second quick-disconnect connectors positioned on said beams adjacent said connection ports, an end portion of said beam received within said opening of said first quick-disconnect connectors to rigidly yet detachably interconnect said posts and said beams for quick and complete assembly and disassembly of said knock-down partition frame.

2. A partition frame as set forth in claim 1, wherein:

said beams have a hollow tubular construction.

3. A partition frame as set forth in claim 2, wherein:

said posts each have a plurality of utility trough ports with associated windows through said posts for passing utility conduits therethrough.

4. A partition frame as set forth in claim 3, including:

at least one utility trough shaped to receive and retain utility conduits therein, and having opposite ends thereof configured to be detachably connected with a horizontally aligned pair of said utility trough ports on said posts.

5. A partition frame as set forth in claim 4, wherein:

said utility trough has a generally U-shaped lateral cross-sectional shape, and extends substantially uninterrupted between said posts.

6. A knock-down portable partition system, comprising:

at least three vertical posts with upper and lower ends and vertical side faces and vertical front and rear faces, said posts forming a pair of side-by-side panel frames with a pair of end posts and a single center post positioned therebetween; said posts having sufficient structural strength to support hang-on accessory units thereon, with a vertical row of slots extending along one of said vertical front and rear faces for hanging a hang-on accessory unit, and beam connection ports on said vertical side faces, each connection port including a window through said vertical side face;

at least four beams extending generally horizontally between said side faces of said posts adjacent the upper and lower ends thereof, and having opposite ends thereof rigidly connected to said beam connection ports to define when in an assembled condition, at least two side-by-side rigid panel frames, each having an interior frame space, said side faces of said posts facing inwardly towards said interior frame spaces each end of each beam having a portion thereof extending into said window, wherein said beams provide the primary structural interconnection between said posts;

at least one cover panel configured to enclose at least a portion of the interior frame space of at least one of said panel frames, and being removably mounted on said one panel frame to readily access the open interior thereof; and a hang-on accessory unit removably attached to at least one of said vertical row of slots of a selected one of said posts.

7. A knock-down portable partition system as set forth in claim 6, wherein:

said posts have a hollow tubular construction with a quadrilateral plan shape formed by said vertical faces, and wherein said posts include quick-disconnect connectors on said posts adjacent said connection ports; and said beams include second quick-disconnect connectors positioned on said beams adjacent said connection ports, and being located thereon to engage said first quick-disconnect connectors to rigidly yet detachably interconnect said posts and said beams for quick and complete assembly and disassembly of said knock-down portable partition.

8. A knock-down portable partition system as set forth in claim 7, wherein:

said posts each have a plurality of utility trough ports with associated windows through said posts for passing utility conduits therethrough; and including at least one utility trough shaped to receive and retain utility conduits therein, and having opposite ends thereof configured to be detachably connected with a horizontally aligned pair of said utility trough ports on said posts.

9. A knock-down portable partition system as set forth in claim 8, wherein:

said utility troughs are removable when said panel frame is in said assembled condition.

10. A knock-down portable partition system as set forth in claim 9, wherein:

said posts each include a pair of horizontally aligned upper utility trough ports on said opposite side faces adjacent said upper end above said upper beam and a pair of horizontally aligned lower utility trough ports on said opposite side faces adjacent said lower end below said lower structural beam.

11. A knock-down portable partition system as set forth in claim 10, wherein:

said panel frame defines a top edge; and said upper portion of said post is disposed a spaced apart distance below the upper end of said post to position the associated one of said structural beams therealong.

12. A knock-down portable partition system as set forth in claim 11, wherein:

said lower portion of said post is disposed a spaced apart distance above the lower end of said post to position the associated one of said structural beams therealong.

13. A knock-down portable partition system as set forth in claim 12, wherein:

at least one of said beams has a hollow tubular construction.

14. A knock-down portable partition system as set forth in claim 8, wherein:

said utility trough includes a pair of downwardly opening hooks at one end thereof that are received within a selected one of said utility trough ports.

15. A knock-down portable partition system as set forth in claim 6, wherein:

at least one of said posts has a unitary construction with a generally L-shaped top plan configuration with beam connection ports on orthogonal side faces for orienting adjacent panel frames in an angular relationship.

16. A knock-down portable partition system as set forth in claim 6, wherein:

at least one of said posts has a unitary construction with a generally X-shaped top plan configuration with beam connection ports on first and second pairs of spaced apart side faces, said first and second pairs orthogonal to one another for orienting adjacent panel frames in an angular relationship.

17. A portable partition, comprising:

at least two vertical posts, each having a unitary construction with a plurality of utility trough ports with associated windows through said posts for passing utility conduits therethrough;

at least two structural beams having opposite ends thereof interconnecting said vertical posts adjacent upper and lower portions thereof to define when in an assembled condition, a rigid panel frame having a substantially open interior;

at least one cover panel configured to enclose at least a portion of the open interior of said panel frame, and being removably mounted on said panel frame to readily access the open interior thereof; and at least one utility trough shaped to receive and retain utility conduits therein, and having opposite ends thereof configured to be detachably connected with a horizontally aligned pair of said utility trough ports on said posts when said panel frame is in said assembled condition.

18. A portable partition as set forth in claim 17, wherein:

said posts each have a hollow tubular construction defining a cavity with said associated windows extending through opposite faces thereof and opening to said cavity.

19. A portable partition as set forth in claim 18, wherein:

said utility troughs have first and second ends thereof positioned in horizontal alignment with the windows on said pair of utility trough ports.

20. A portable partition as set forth in claim 19, wherein:

said second end of said utility trough includes vertically oriented notches which engage an adjacent edge of the associated port window to longitudinally lock said utility trough in said panel frame.

21. A portable partition as set forth in claim 20, wherein:

said utility trough ports each include at least one slot adjacent to the associated one of said windows; and said first end of said utility trough includes a tab which is received in said slot to vertically lock said utility trough in said panel frame.

22. A portable partition as set forth in claim 21, wherein:

said utility trough has an inverted U-shaped configuration which extends substantially uninterrupted between said posts.

23. A portable partition as set forth in claim 22 wherein:

said windows have a rectangular shape.

24. A knock-down portable partition, comprising:

a panel frame having a rigid perimeter with a substantially open central portion, and first quick-disconnect connectors thereon;

at least one cover panel covering at least a portion of the open central portion of said panel frame, and having second quick-disconnect connectors thereon which mate with the first quick-disconnect connectors on said panel frame to facilitate manual assembly and removal of said cover panel on said panel frame;

said panel frame including:

at least two vertical posts, each having a front face, a rear face, and opposite side faces with at least two beam connection ports thereon positioned adjacent upper and lower portions of the associated one of said posts; each of said beam connection ports including a pair of slots extending through the associated side face of said post, and having a predetermined shape, and first and second pairs of horizontally aligned fastener apertures positioned adjacent opposite sides of each said slot in said front and rear faces of said one of said posts;

at least two structural beams rigidly yet detachably interconnecting said vertical posts adjacent the upper and lower portions thereof; each end of each of said beams having at least two longitudinally extending tabs having a transverse cross-sectional shape similar to the predetermined shape of said slots for close reception therein, and a third pair of fastener apertures extending transversely through said beam in horizontal alignment with said first and second pairs of fastener apertures; and a plurality of fastener pins closely yet manually received in the first, second and third pairs of fastener apertures of each of said beam connections ports to positively retain said beams locked in said posts, whereby said portable partition can be completely assembled and disassembled manually without tools.

25. A knock-down portable partition as set forth in claim 24, wherein:

each of said posts includes two pairs of said connection ports positioned adjacent the upper and lower portions thereof, with the connection ports in each of said sets being horizontally aligned to facilitate mounting four of said structural beams to each of said posts.

26. A knock-down portable partition as set forth in claim 25, wherein:

at least one of said structural beams has a tubular construction.

27. A knock-down portable partition as set forth in claim 26, wherein:

said cover panel is non-structural.

28. A knock-down portable partition as set forth in claim 27, wherein:

said fastener pins have a key-shaped side elevational configuration.

29. A knock-down portable partition, comprising:

at least two vertical posts having a hollow tubular construction, each having at least four windows through opposite sidewalls thereof;

upper and lower beams having opposite ends thereof extending between vertical posts adjacent upper and lower portions thereof and engaging said windows to define when in an assembled condition, a rigid panel frame having a substantially open interior; and at least one cover panel configured to enclose at least a portion of the open interior of said panel frame, and being removably mounted on said panel frame to readily access the open interior thereof.

30. A knock-down portable partition as set forth in claim 29, including:

at least one utility trough shaped to receive and retain utility conduits therein, and having opposite ends thereof configured to be detachably connected with a horizontally aligned pair of said utility trough ports on said posts when said panel frame is in said assembled condition.

31. A knock-down portable partition as set forth in claim 30, wherein:

said posts have sufficient structural strength to support hang-on accessory units thereon, and include a vertical row of slots along at least one sidewall thereof for hanging the hang-on accessory units.

32. A knock-down portable partition as set forth in claim 31, wherein:

said utility troughs are removable when said panel frame is in said assembled condition.

33. A knock-down portable partition as set forth in claim 29, wherein:

each said window comprises at least one slot extending through said opposite faces, and having a predetermined shape; and said opposite ends of said beams each include at least two longitudinally extending tabs having a transverse cross-sectional shape similar to said slots for close reception therein.

34. A knock-down partition frame construction for portable partitions, comprising:

a pair of horizontally spaced-apart upright posts defining vertical front and rear faces, each post including a vertical row of openings through said front and rear faces for supporting hang-on accessory units;

a pair of vertically spaced-apart structural beams extending between said posts and rigidly, yet releasably interconnecting said posts to form a rigid partition frame; and each said beam defining opposite ends, each of which includes at least first and second spaced-apart connectors providing a rigid, moment-reacting connection between said beams and said posts, said first connectors including a movable lock key and a key receiving portion that receives said lock key to interconnect said posts and beams.

35. The knock-down partition frame construction set forth in claim 34, wherein:

said key receiving portions are formed at least in part by transverse openings through said beams by openings through said beams that receive said lock keys.

36. The knock-down partition frame construction set forth in claim 35, wherein:

each post defines a pair of vertical opposite side faces, each of which includes a window therethrough having a side edge; and said second connectors including a transverse slot in said beam, with said side edge received within said slot.

37. The knock-down partition frame construction set forth in claim 36, wherein:

said beams are tubular, with a generally rectangular cross-section defining an elongated cavity therein.

38. The knock-down partition frame construction set forth in claim 37, wherein:

said key receiving portions further include openings through said front and rear faces of said posts that are horizontally aligned with said openings through said beams, said lock keys extending through said openings in said posts and said beams.

39. The knock-down partition frame construction set forth in claim 34, wherein:

each post defines a pair of vertical side faces, each having a plurality of utility trough ports, each of which includes an opening through said post to permit routing of utility lines through said post; and including:

at least one utility trough having an upwardly-opening U-shaped cross section for retaining utility lines therein, said utility trough having opposite ends, each of which is removably connected to a selected utility trough port.

40. The knock-down partition frame construction set forth in claim 39, wherein:

each utility trough port includes a pair of slots adjacent said opening; and each end of said utility trough including a pair of hooks, each received in a slot for support of said utility trough.

41. A knock-down partition frame construction for portable partitions, comprising:

a pair of horizontally spaced-apart upright posts including a plurality of vertically spaced beam connection ports, each post defining vertical front and rear faces, each post including a vertical row of openings through said front and rear faces for supporting hang-on accessory units;

a pair of structural beams extending between said posts, each beam having opposite ends thereof rigidly, yet releasably interconnected with said posts to form a rigid partition frame having sufficient strength to support hang-on accessory units;

threadless quick connectors rigidly interconnecting each end of each said beam with a selected one of said beam connection ports; and at least one utility trough spanning said posts and having a utility raceway extending therealong for routing of utility lines.

42. The knock-down partition frame construction for portable partitions set forth in claim 41, wherein:

said utility trough has an upwardly-opening U-shaped cross-section.

43. The knock-down partition frame construction for portable partitions set forth in claim 42, wherein:

said posts include a plurality of utility trough connection ports, each having a pair of spaced-apart apertures; and said utility trough defines opposite ends, each having a pair of hooks, each hook received within a selected one of said apertures and supporting said utility trough.

* * * * *